United States Patent [19]

Nordlof

[11] Patent Number: 4,669,645

[45] Date of Patent: Jun. 2, 1987

[54] STOCK FEED APPARATUS

[76] Inventor: Richard D. Nordlof, 3312 Crest Rd., Rockford, Ill. 61107

[21] Appl. No.: 829,210

[22] Filed: Feb. 14, 1986

[51] Int. Cl.[4] ..... B65H 20/00; B65H 23/06

[52] U.S. Cl. ..... 226/134; 226/147; 226/150; 226/158; 226/162

[58] Field of Search ..... 226/134, 136, 147, 149, 226/150, 158, 162

[56] References Cited

U.S. PATENT DOCUMENTS

| | | | |
|---|---|---|---|
| 3,038,645 | 6/1962 | Nordlof . | |
| 4,095,733 | 6/1979 | Scribner | 226/162 |
| 4,175,688 | 11/1979 | Scribner | 226/158 |

*Primary Examiner*—Stuart S. Levy
*Assistant Examiner*—Lynn M. Sohacki
*Attorney, Agent, or Firm*—Vernon J. Pillote

[57] ABSTRACT

A fluid operated stock feed apparatus for intermittently advancing stock along a feed path. The feed apparatus includes a stationary body having fluid operated stock holding clamps mounted thereon. A stock feed head is mounted for reciprocation relative to the body and has fluid operated stock feed clamps mounted thereon and a feed piston is mounted in the body for extending and retracting the stock feed head. A main control valve is provided in the body for controlling the application of fluid pressure to the fluid pressure operated stock holding and stock feed clamps and a pressure operated auxiliary valve is provided in the body and is responsive to the pressure from the main control valve for controlling the application of fluid pressure to the feed piston. The main body is formed with a bore therethrough and the feed cylinder is provided in one portion of the bore. The pressure operated auxiliary valve including an auxiliary valve casing, an auxiliary valve member and a pressure operator therefor, is mounted another portion of the bore at one end of the feed cylinder. The feed cylinder is formed by a sleeve disposed in the bore and arranged to provide a pressure chamber around the sleeve.

12 Claims, 6 Drawing Figures

5
5

STOCK FEED APPARATUS

BACKGROUND OF THE INVENTION

This invention relates to fluid operated stock feed apparatus for intermittently advancing strip stock along a feed path and particularly to improvements in fluid operated stock feed apparatus of the type disclosed in the applicant's prior U.S. Pat. No. 3,038,645. The stock feed apparatus disclosed in that patent in general included a stationary body, a fluid operated stock holding clamp mounted on the body, a feed head mounted for reciprocation relative to the body and having a fluid operated stock feed clamp mounted thereon, and a fluid operated feed piston slidably mounted in a feed cylinder bore in the stationary body for extending and retracting the feed head relative to the stock holding clamp. A main control valve was mounted on the body for controlling application of fluid pressure to the fluid operated stock holding clamp and stock feed clamp, and an auxiliary valve was mounted in a stepped valve bore in the body and operated by fluid pressure from the main control valve to control the application of fluid pressure to the feed piston to extend and retract the feed head in timed relation with the operation of the stock holding and stock feed clamps.

While the prior stock feed apparatus operated satisfactorily, it was somewhat expensive to machine and assemble. It was necessary to machine a feed cylinder bore and a separate stepped valve bore in the body, and to machine numerous holes or passages in the body to interconnect the main valve and the auxiliary valve and the fluid operated stock feed and holding clamps and the fluid operated feed piston and some of these passages were at angles that were not orthogonal to the axis of the feed cylinder. The feed piston was slidably mounted directly in the feed cylinder bore and it was accordingly necessary to machine the feed cylinder bore to a smooth finish.

SUMMARY OF THE INVENTION

An important object of the present invention is to provide an improved fluid operated stock feed apparatus of the type described which can be more economically machined and assembled.

Accordingly, the present invention provides a fluid operated stock feed apparatus including a stationary body having a fluid operated stock holding clamp mounted thereon, a feed head mounted for reciprocation relative to the body and having a fluid operated stock feed clamp mounted thereon, a fluid operated piston slidably mounted in a feed cylinder means in the stationary body for extending and retracting the feed head relative to the stock holding clamp, a main control valve mounted on the body for controlling application of fluid pressure to the fluid operated stock holding clamp and stock feed clamp, and an auxiliary valve operated by fluid pressure from the main control valve and arranged to control the application of fluid pressure to the feed piston to extend and retract the feed head in timed relation with the operation of the stock holding and stock feed clamps, and in which the feed piston is slidably mounted in one portion of a bore in the body and the auxiliary valve including an auxiliary valve casing, auxiliary valve member and fluid pressure operator therefor are removably mounted in a second portion of the bore coaxial with the feed piston, to control the application of fluid pressure to the feed piston.

In accordance with another aspect of this invention a fluid operated stock feed apparatus of the type set forth above, is provided with an improved feed cylinder means which sleeve is removably mounted in the bore in the stationary body to provide a cylinder inside the sleeve for the feed piston and a pressure chamber between the sleeve and the bore for transmitting fluid pressure to the rod end of the feed piston.

Figure 1:
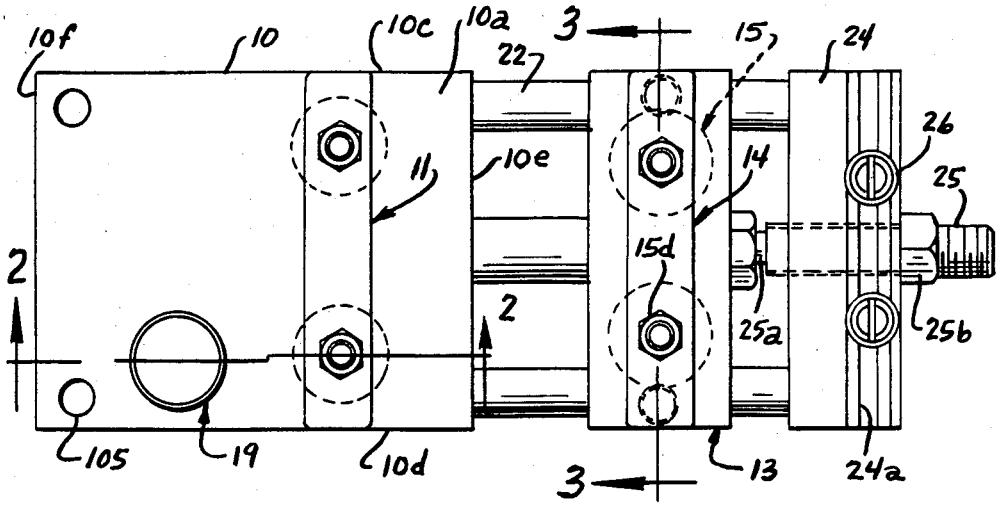
FIG. 1 is a top plan view of the stock feed apparatus with the stock feed head in an intermediate position.

The stock feed apparatus of the present invention is adapted for intermittently feeding strip stock to a punch press or the like in timed relation with the operation of the press. As disclosed more fully in the aforementioned U.S. Pat. No. 3,038,645, the stock feed apparatus is arranged to be mounted on a punch press or the like, as by attachment to the bolster plate of the press to feed stock to the press, and the main control valve is operated as by a valve actuator carried by the press ram to cycle the stock feed apparatus in timed relation with the reciprocation of the ram.

In general, the stock feed apparatus includes a stationary body 10 and a stock holding clamp 11 mounted on the body and actuated from a stock release to a stock engaging position by a fluid pressure actuator 12. A stock feed head 13 is mounted for reciprocation relative to the body in a direction paralleling the path of stock advance and a stock feed clamp 14 is mounted on the feed head and operated from a stock release to a stock engaging position by fluid pressure actuators 15. A feed cylinder means 16 is provided in the body and a feed piston 17 is slidable in the feed cylinder means and has its piston rod connected to the feed head for extending and retracting the same. A pressure operated auxiliary control valve 18 is provided for controlling the application of fluid pressure to the feed piston, and a main control valve 19 is provided in the body for controlling the application of fluid pressure to the fluid actuators for the stock holding and stock feed clamps and for also controlling the application of fluid pressure to the auxiliary valve.

Figures 4, 5, 6:
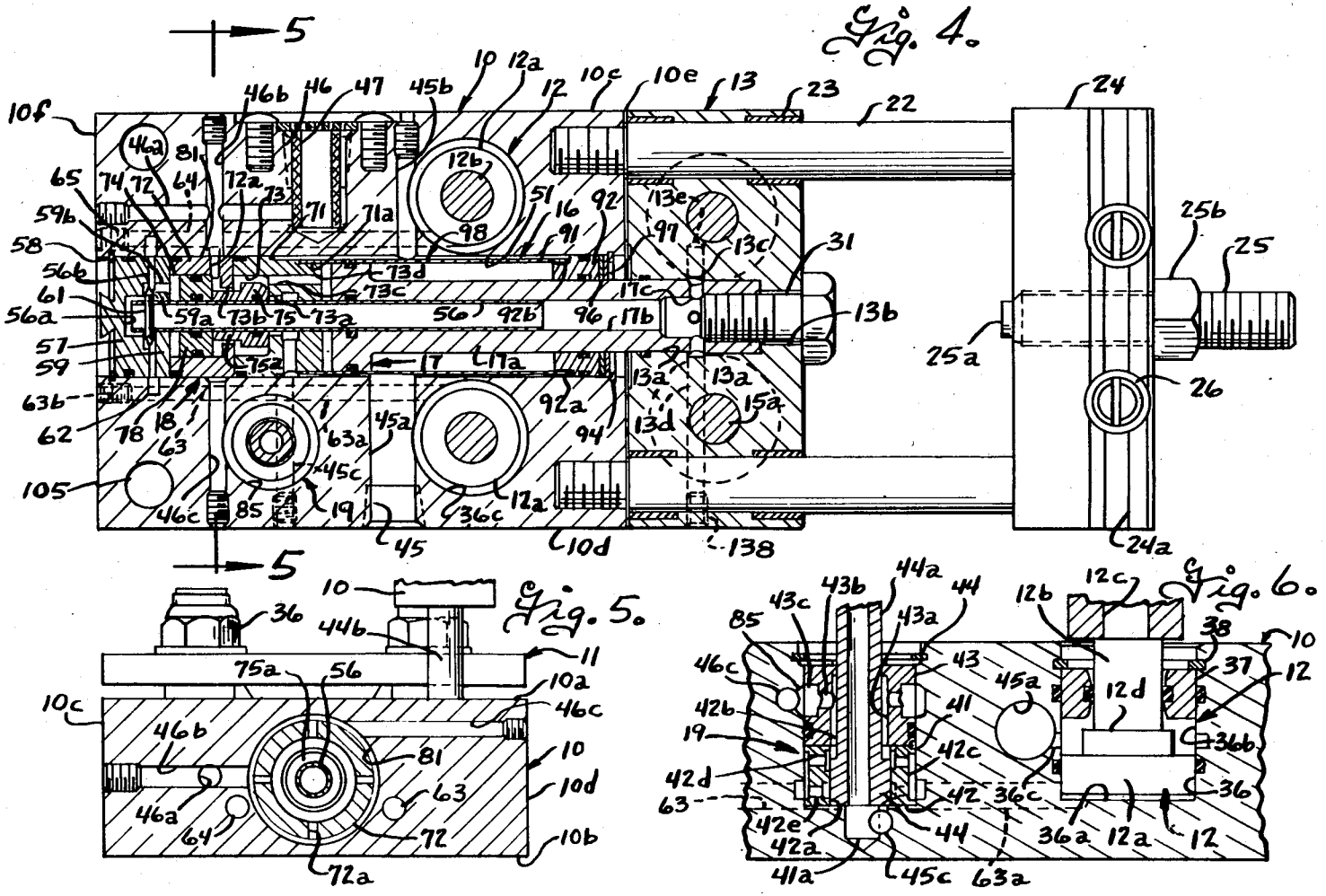
FIG. 4 is a fragmentary horizontal sectional view through the stock feed apparatus.
FIG. 5 is a transverse sectional view taken on the plane 5—5 of FIG. 4.
FIG. 6 is a fragmentary longitudinal sectional view taken on the plane 2—2 of FIG. 1 and illustrating the parts on a larger scale and in a moved position.

The stationary body 10 is conveniently in the form of a generally rectangular block having upper and lower side faces 10*a*, 10*b*, side edges 10*c* and 10*d* and end faces 10*e* and 10*f*. A pair of generally parallel guide rods 22 are mounted on the body 10 and extend from one end 10*e*, and the feed head 13 is slidably supported on the guide rods as by bushings 23. A crosshead 24 extends between the outer ends of the guide rods 22 and an adjustable stop 25 is mounted on the crosshead as by threaded engagement therewith to limit the stroke of the feed head. As best shown in FIGS. 1 and 4, the stop 25 has a nose 25*a* arranged to engage a part on the feed head 13, and the stop is adjustable in the crosshead 24 and is adapted to be locked in adjusted position by a lock nut 25*b*. Strip guides 26 are provided on the crosshead 24 to laterally guide the strip stock and the strip guides are advantageously mounted as in a T-shaped slot 24*a* in the crosshead for adjustment in a direction crosswise of the feed path, to accommodate stock of different width.

Figure 3:
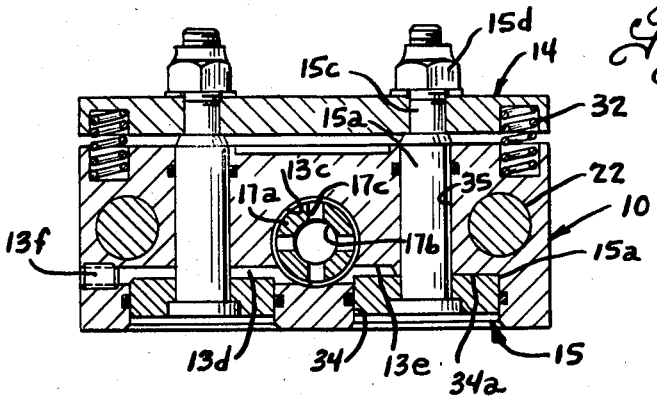
FIG. 3 is a transverse sectional view through the stock feed head taken on the plane 3—3 of FIG. 1 and illustrating the parts on a larger scale than Fig.1.

The stock feed piston 17 has a piston rod 17*a* extending from one side of the piston and out of the feed cylinder and into a counterbore 13*a* in the feed head (see FIG. 4), and a bolt 31 extends through an opening 13b in the feed head and is threaded into the end of the piston rod 17*a* to secure the feed head to the piston rod for movement therewith. As best shown in FIG. 3, the stock feed clamp 14 is yieldably biased to a stock release position by springs 32. The fluid actuators 15 for the stock feed clamp comprise a pair of pistons 15*a* slidably mounted in cylinders 34 formed in the underside of the feed head 13 and the pistons 15 have piston rods 15*a* extending upwardly through bores 35 in the feed head. The stock feed member 14 is attached to reduced diameter extensions 15*c* on the upper ends of the piston rods 15*b*, as by nuts 15*d*. A means such as O-rings are provided to form a sliding seal between the periphery of the pistons 15*a* and the cylinders 34 and also between the piston rods 15*b* and the bore 35 to seal the fluid pressure chamber 34*a* at the upper or rod side of the piston. As best shown in FIGS. 3 and 4, the rod 17*a* of the feed piston 17 is formed with an axial passage 17*b* and lateral passages 17*c* that communicate one end of the axial passage 17*b* with a pressure distribution groove 13*c* in the counterbore 13*a*, and passages 13*d* and 13*e* are formed in the feed head to communicate the pressure distribution groove 13*c* with the chambers 34*a* of the cylinders 34. The passages 13*d* and 13*e* can conveniently be formed by drilling a hole from one end of the feed head 13 at a location to extend across and intersect the upper sides of the feed cylinders 34 and also intersect the pressure distribution groove 13*c*. The end of the hole is thereafter closed with a plug 13*f*.

Figure 2:
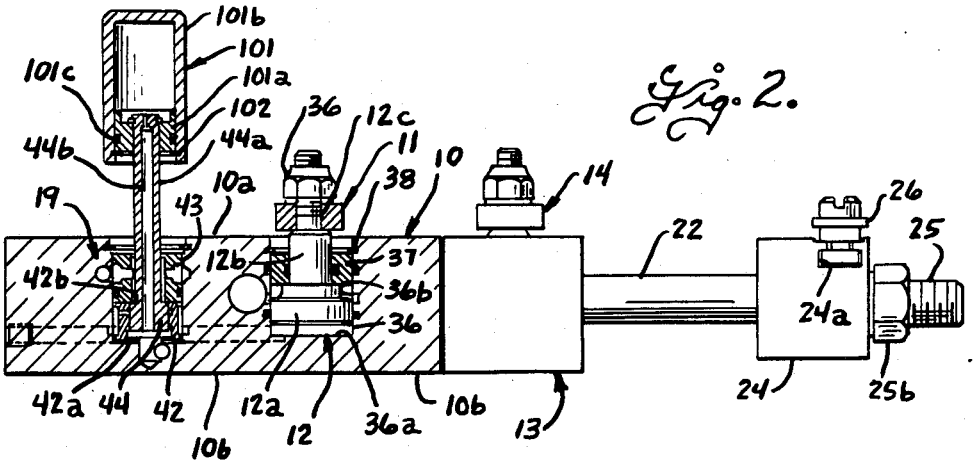
FIG. 2 is a side elevational view of the stock feed apparatus with parts broken away along a section line 2—2 of FIG. 1 to illustrate details of construction.

As best shown in FIGS. 2 and 6, the fluid operator 12 for the stock holding clamp 11 comprises a pair of cylinders 36 formed in the body 10 at opposite sides of the feed cylinder means 16, the cylinders being closed at their lower ends and having an annular sealing gland 37 removably retained in the cylinders intermediate their ends as by a split retainer ring 38. The fluid operator 12 also includes clamp pistons 12*a* slidably disposed in the lower portion of the cylinder 36 and rods 12*b* that slidably extend through the respective sealing gland 37. The rods 12*b* have reduced diameter upper ends 12*c* secured to the stock holding clamp 11 as by nuts 36, with the clamp extending between the pair of clamp pistons and crosswise of the stock feed path. A means such as O-rings are provided to form a seal between the cylinder 36 and the sealing gland 37 and also to form a sliding seal between the periphery of the clamp piston 12*a* in the cylinder and between the rod 12*b* and the sealing gland. The fluid operators 12 for the stock holding clamp are preferably of the double acting type with a first fluid pressure chamber 36*a* formed in the cylinders 36 at the underside of the pistons 12*a* and a second fluid pressure chamber 36*b* formed in the cylinder at the upper or rod side of the pistons. Each piston 12*a* is advantageously formed with a shoulder 12*d* spaced above its upper side and arranged to engage the sealing gland 37 and to limit upward travel of the piston as shown in FIG. 2.

The main control valve 19 is arranged to control the application of fluid pressure to the fluid actuators 12 for the stock holding clamp and the fluid actuators 15 for the stock feed clamps. As best shown in FIGS. 2 and 6, a main valve cylinder 41 is formed in the body 10 and is closed at its lower end and opens at the upper side of the body. An annular main valve casing member 42 is positioned in the lower end of the cylinder 41 and an annular sealing gland 43 is provided in the upper portion of the cylinder and is retained therein by a split ring 44. The valve casing member 42 defines an internal valve chamber having an inlet port 42*a* at its lower end and an exhaust port 42*b* at its upper end. The valve member has an external annular recess 42*c* that defines a main control port and upper and lower passage means 42*d* and 42*e* that communicate the valve chamber with the main control port at axially spaced locations. A cylindrical main valve member 44 is slidably mounted in the valve chamber in the valve casing member 42 and is movable from a first position shown in FIG. 2 communicating the pressure inlet port 42*a* with passage 42*e* and control port 42*c* while blocking the exhaust port 42*b*, to a second position communicating the exhaust port 42*b* with passage 42*d* and control port 42*c* while blocking pressure inlet port 42*a*.

Pressure supply passage means 45 are formed in the stationary body 10 and adapted for connection to a source of gaseous fluid pressure such as a source of compressed air, and an exhaust passage means 46 is adapted for communication to a low pressure area, for example to the surrounding atmosphere. A muffler 47, conveniently in the form of a perforated or foraminous screen, is advantageously provided in the outlet of exhaust passage means to reduce noise of the exhaust air.

The stationary body 10 is formed with a cylindrical bore 51 that extends parallel to the stock feed path from one end 10*e* to the other end 10*f* of the body. A tube 56 is slidably disposed in the passage 17*b* that extends through the piston and piston rod and the tube is anchored at its other end to the stationary body 10. As best shown in FIG. 4, an annular head 57 is removably mounted in one end portion of the cylindrical bore 51 and sealed thereto as by an O-ring to close one end of the bore 51, and the head is removably retained in position as by a split ring 58. A disc member 59 is removably disposed in the bore and has a central opening 59*a* to receive and center one end of the tube 56 in the bore 51, and a means such as a transverse pin 61 extends through the end of the tube and is retained between the disc member 59 and the head member 57 to hold the tube 56 against endwise movement. The head member 51 and disc 59 define a control pressure chamber 56*a* therebetween in one end of the cylindrical bore 51 and the control pressure chamber communicates with one end of the tube 56 and through tube 56 and passage 17*b* in the piston rod with the cylinder chambers 34*a* in the feed head. The control pressure chamber 56*a* also communicates through passages 56*b* with a pressure distribution groove recess 62 around one end of cylindrical bore 51 in the stationary body.

A main control passage means is provided in the body to communicate the main control port 42*c* of the main control valve with the fluid pressure chambers 36*b* of the clamp cylinders and also with the control pressure chamber 56*a* to supply fluid through tube 56 and passage 56b in the piston to the fluid pressure chambers 34a in the feed cylinders. The main control passage means includes a passage 63 that communicates the control outlet port 42c of the main control valve member with the recess 62 and hence with the control pressure chamber 56a. Main control passage 63 can conveniently be formed by drilling a hole into one end lOof the stationary body at a location to intersect both the recess 62 and the main control port 42c and the bore can be extended as indicated at 63a to also communicate the control port 42c with the fluid pressure chamber 36a of one of the fluid pressure actuators 12 for the stock holding clamp. The end of the drilled hole provided to form the main control passage is closed as by a plug 63b after drilling. The main control passage means in the body 10 also includes a hole 64 drilled into the body from the end 10f at a location to intersect the pressure distribution groove 62 and to communicate at its other end with the pressure chamber 36a for the other fluid pressure actuator for the stock holding clamp. The end of the hole 64 is closed as by a plug 65 after drilling.

The auxiliary valve 18 for controlling the application of fluid pressure to the feed cylinder includes annular stationary valve casing means formed by annular valve casing members 71 and 72 removably disposed in the bore 51 and sealed thereto as by O-rings. The valve casing members 71 and 72 define a cylindrical auxiliary valve chamber 73 coaxial with the bore 51 and having end faces spaced apart in a direction axially of the tube 56 with an auxiliary pressure inlet port 73a in one end face and an auxiliary exhaust port 73b in the other end face. An auxiliary control port 73c and passage 73d communicates the auxiliary chamber with the cylinder means 16 at one side of the feed piston 17 to apply an exhaust fluid pressure therefrom. The auxiliary valve casing members also define an auxiliary valve actuator cylinder 74 spaced axially from the auxiliary valve chamber 73. An auxiliary valve member 75 is disposed in the auxiliary valve chamber 73 and is advantagously guidably mounted on the tube 56. The auxiliary valve member has axially spaced end faces that are spaced apart somewhat less that the spacing between the end faces of the valve chamber and the auxiliary valve member is axially movable from a first position communicating the auxiliary pressure inlet port 73a with the auxiliary control port 73 while blocking flow through the auxiliary exhaust port 73b, to a second position as shown in FIG. 4 communicating the auxiliary control port 73c with the exhaust port 73b while blocking flow through the auxiliary inlet port 73a. The auxiliary valve member 75 has a reduced diameter axial extension 75a that extends through the exhaust port 73b and spaced upwardly therefrom to communicate the valve chamber with the valve cylinder 74. A valve actuating piston 78 is slidably mounted in valve cylinder 74 and engages the end of the extension 75a on the auxiliary valve member 75. A passage 59b in the plate member 59 communicates the control pressure chamber 56a with the valve actuating cylinder 74 at the side of the valve actuating piston 78 opposite the valve member 75. The valve casing member 72 has an exhaust passage 72a that communicates with the valve actuating cylinder 74 at the other side of the piston and also with the exhaust port 73b in the valve chamber. Exhaust passage 72a can conveniently be formed by drilling one or more generally radially extending holes through the valve casing member, and the exhaust passage 72a communicates with the exhaust passage means 46 by way of a groove 81 formed around the cylindrical bore 51 in the body 10 intermediate the ends of the bore 51. As best shown in FIGS. 4 and 5, the exhaust passage means is conveniently formed by a hole 46a drilled into the body from one end 10f at a location to intersect the exhaust outlet 46, and a second hole 46b drilled into the body from the side 10d at a location to intersect the hole 46a and the distribution recess 81. The outer ends of holes 46a and 46b are closed by plugs after drilling. The exhaust passage means also includes a hole 46c drilled into the body from the side 10c at a location to communicate the pressure distribution recess 81 with a pressure distribution recess 85 around the main valve cylinder 41. The outer end of hole 46c is closed by a plug after drilling.

As shown in FIG. 6, the sealing gland 43 in the main valve cylinder 41 has a downwardly opening axial passage 43a that communicates at its lower end with the main exhaust port 42b and lateral passages 43b that communicates with an external annular recess 43c in the sealing gland and which is adapted to register with the pressure distribution recess 85 formed around the valve bore 41 in the body to communicate the main exhaust port with the exhaust passage means 45. The auxiliary valve member 75 and valve actuating piston 78 are preferably formed of a resilient synthetic resin material. The auxiliary valve member 75 may, for example be formed of nylon and the auxiliary valve piston 78 formed of a polycarbonate plastic such as "Lexan".

The body 10 is conveniently formed of an easily machinable material such as aluminum and, in accordance with another aspect of the present invention, the feed cylinder means 16 is advantageously formed by a sleeve 91 of a wear resistant material for example stainless steel, and which is disposed in one portion of the bore 51 between the valve casing member 71 and an annular piston head member 92. As best shown in FIG. 4, the valve casing member 71 is formed with a reduced diameter end portion 71a and one end of the sleeve 91 is adapted to be press fit on and sealed to that portion of the auxiliary valve casing member. The cylinder head member 92 is removably mounted in the bore and has a reduced diameter portion 92 adapted to receive and center the other end portion of the sleeve 91. The piston rod slidably extends through the cylinder head member 92 and a means such as an O-ring is provided to form a sliding seal between the cylinder head member and the piston rod with a second O-ring at the outer periphery of the cylinder head member to form a seal with the cylinder bore 91. The cylinder head member is removably retained in the bore as by a split ring 94 and a lubricant retaining wiper 96 is disposed in the bore and retained in position as by a washer 97.

The cylinder sleeve 91 has a outer diameter sufficiently smaller than the bore 51 to define a pressure chamber 98 in the bore and around the sleeve. The cylinder head member 92 is formed with one or more recesses 92b that are arranged to communicate the pressure chamber 98 with the interior of the sleeve at the rod side of the piston, to supply fluid pressure to the rod side of the piston and bias the latter in one direction. As previously described, the auxiliary valve means controls the application of fluid pressure to the other end face of the piston 17 to effect movement of the piston in the other direction.

The pressure chamber 98 around the sleeve is also utilized to transmit fluid pressure to other parts of the feed apparatus. Thus, as shown in FIG. 4, the fluid pressure supply passage means in the valve body includes a hole 45a that is drilled into one side 10c of the valve body and which intersects the bore 51 to supply fluid pressure to the chamber 98. The hole 45a is also advantageously arranged to intersect a pressure distribution groove 36c that is formed around the cylinder 36 in the body 10 at a level to communicate with the upper chamber 36b and supply fluid pressure to the upper chamber of the stock clamp actuating means. The pressure supply passage means also includes a hole 45b conveniently formed by drilling into the body 10 from the side 10d at a location to communicate with the bore 91 and to also intersect a pressure distribution groove 36c formed around the other clamp cylinder 36 to supply fluid pressure thereto. The outer end of hole 45b is closed by a plug. The pressure supply passage means also includes a third hole 45c conveniently formed by drilling into the body from the side 10d at a location to communicate at one end with the pressure chamber 98 and to intersect a chamber 41a at the lower end of the main valve cylinder 41, to supply fluid pressure to the inlet of the main control valve 19. The outer end of hole 45c is closed by a plug after drilling.

The main control valve 44 has a stem 44a that extends upwardly through the sealing gland 43 and has an overtravel actuator 101 at its upper end. The fluid pressure in chamber 41a normally urges the main control valve to a raised position communicating the pressure inlet port with the control passage means 63 and the main valve member is operable to its second position in response to pressure applied to the upper end of the valve stem 44a. As disclosed in the aforementioned U.S. Pat. No. 3,038,645, the overtravel actuator 101 includes a head 101a on the upper end of the valve stem and a cup shaped member 101b having an open lower end slidably supported on the head 101a and sealed thereto as by an O-ring 101c. Stem 44a has an axial passage 44b therethrough communicating at its lower end with the pressure chamber 41a and at its upper end with the interior of the cup-shaped member 101b to normally urge the cup-shaped member to a raised position. A means such as a split ring 102 limits upward movement of the cup-shaped member relative to the head 101a. Thus, fluid pressure is supplied to the cup-shaped member to normally urge it to a raised position and, when a downward force is applied to the upper end of the cup-shaped member 101b as by press ram, it initially moves the main control valve downwardly to its second position and further depression of the cup-shaped member accommodates overtravel of the press ram.

From the foregoing it is thought that the construction and operation of the stock feed apparatus will be readily understood. The stock feed apparatus is adapted to be mounted on the punch press as by bolts or fasteners that extend through mounting holes 105 in the body 10. The fluid pressure passage means 45 is connected to a source of gaseous fluid pressure such as the plant air supply, and air under pressure is continuously supplied through passages 45a to the pressure chamber 98 around the sleeve and also through passages 45a and 45b to the upper chambers 36b of the fluid pressure actuators for the stock holding clamp to normally bias the stock holding clamp downwardly to a stock engaging position. Fluid pressure is also continuously supplied through passages 45c to the chamber at the lower end of the valve cylinder 41 and normally biases the main control valve to a raised position shown in FIG. 2. When the main control valve is in its raised position, it supplies fluid pressure through control outlet port 42c and main control passages 63, 63a and 64 to the lower chambers 36a of the clamp actuating cylinders. The effective area at the rod end face of the clamp pistons 12a is smaller than the area at the lower face of the clamp pistons and, when fluid pressure is applied to the chamber 36a it moves the clamp pistons upwardly to move the stock clamp 11 to its raised or stock disengaging position. When the main control valve supplies fluid pressure to the control passages it also pressurizes control chamber 56a and supplies fluid pressure through tube 56 and passage 17b in the piston to the pressure chambers 34a in the feed head to move the feed clamp downwardly to a stock engaging position. When fluid pressure is applied to the control chamber 56a, it also actuates valve actuating piston 74 of the auxiliary control valve to move the auxiliary control valve 75 to the position shown in FIG. 4 communicating the auxiliary control outlet 73c with the exhaust port 73b and blocking flow from the auxiliary inlet 73a. Thus, under these conditions, fluid pressure is exhausted from the end of the feed cylinder opposite the rod 17a and the feed piston is moved to the left as shown in FIG. 4 under the fluid pressure applied to the rod end face of the feed piston.

When the main control valve is moved down to its second or lower position shown in FIG. 6, it communicates the control outlet port 42c with the exhaust port 42b. Under these conditions, fluid pressure is exhausted from the chambers 36a at the lower side of the clamp pistons 12a so that the clamp pistons move downwardly under the fluid pressure that is continuously supplied to the upper rod end face of the clamp pistons. When the control valve is in its second position, it also exhausts fluid pressure from the upper chambers 34a of the stock feed cylinders and the springs 32 then move the stock feed clamp upwardly to a stock release position. When the main control valve is in its second position communicating the control with the exhaust outlet, it also exhausts fluid pressure from the valve actuating cylinder 74 and fluid pressure on the opposite end of the auxiliary valve member 75 moves the valve member and piston from the position shown in FIG. 4 to a position in which the valve member communicates the pressure inlet port 73a with the control port and closes the auxiliary exhaust port 73b. Fluid pressure is then supplied to the end of the feed cylinder to move the feed piston and feed head to the right as viewed in FIG. 4. Thus, the stock holding clamp is moved to a stock engaging position and the stock feed clamp is moved to a stock release position just prior to movement of the feed head to the right to an extended position against the stop 25a. The stock holding clamp is moved to its release position and the stock feed clamp to a stock engaging position when the feed head is moved to the left toward its retracted position as shown in FIG. 4. As will be seen, the length of the stroke of the feed head and hence the length of stock fed can be adjusted by the adjustable stop 25. As previously described, the strip guides 26 are laterally adjustable to accommodate stock of different widths.

In the stock feed apparatus disclosed herein, it is only necessary to machine one bore in the body for both the feed piston and the auxiliary valve. The auxiliary valve including the auxiliary valve casing members and the auxiliary valve member and valve actuator piston can be easily formed on a screw machine and thereafter assembled in the bore. Mounting the auxiliary valve in the same bore with the feed cylinder also simplifies the formation of the various holes or passages for communicating the several valves and fluid actuators and feed pistons. The provision of a sleeve for the feed piston cylinder not only reduces wear problems but also simplifies the passage arrangement for supplying fluid pressure to the rod end of the cylinder. As shown, the passages can be easily formed by drilling holes that are orthogonal to the axis of the feed cylinder.

The embodiments of the invention in which an exclusive property or privilege is claimed are defined as follows:

1. A stock feed apparatus for intermittently advancing strip stock along a feed path comprising, a body having a bore therein generally paralleling the feed path, the bore having a cylinder means in a first portion of the bore and fluid pressure operated valve means in a second portion of the bore, a feed piston mounted for axial reciprocation in the cylinder means and having a piston rod extending from one side of the piston and out of one end of the cylinder means, the piston having a rod end face at said one side and a main end face at the other side larger than said rod end face, a feed head on the piston rod external of said cylinder means, a feed clamp mounted on the feed head and a first fluid pressure operated means on the feed head for moving the feed clamp from a stock release to a stock engaging position, a stock holding clamp mounted on the body and a second fluid pressure operated means on the body for moving the stock holding clamp from a stock engaging position to a stock release position, the feed piston and piston rod having an axial passage extending through the piston and into the piston rod and communicating at the end remote from the piston with said first fluid pressure operated means, a tube slidably extending into the passage in the piston and piston rod and having one end communicating with that passage, means for anchoring the tube against axial movement relative to the body, the body having pressure supply passage means therein adapted for connection to a source of fluid pressure and exhaust passage means, a main control valve means including a main valve chamber in the body having a main valve inlet port communicating with said pressure supply passage means and a main exhaust port communicating with said exhaust passage means and a main control port, said main control valve means including a main control valve member in the main valve chamber movable from a first position communicating the main control port with the main inlet port and a second position communicating the main control port with the main exhaust port, means in said second portion of the bore defining a control chamber communicating with a second end of the tube, main control passage means in the body communicating said main control port with said control chamber and with said second fluid pressure operated means to supply fluid pressure thereto when the main control valve is in said first position, said pressure operated valve means including valve casing means removably disposed in said second portion of the bore and defining an auxiliary valve chamber having an auxiliary inlet port and an auxiliary exhaust port and an auxiliary control port, said valve casing means having a first passage means communicating the auxiliary inlet port with said pressure supply passage means in the body and a second passage means communicating the auxiliary exhaust port with said exhaust passage means in the body, said valve casing means having auxiliary control passage means communicating said auxiliary control port with said cylinder means to apply and exhaust fluid pressure from the main end face of the piston, said pressure operated valve means including an auxiliary valve member movable between a first position communicating said auxiliary control port with said auxiliary inlet port and a second position communicating said auxiliary control port with said auxiliary exhaust port, and pressure operated valve actuating means in said valve casing means, responsive to the pressure in said control chamber for moving said auxiliary valve member from said first to said second position when the main control valve supplies fluid pressure to the control chamber.

2. A stock feed apparatus according to claim 1 wherein said auxiliary valve member is guidably mounted on said tube for movement between said first and second positions.

3. A stock feed apparatus according to claim 2 wherein said valve casing means includes means defining a valve cylinder, said pressure operated valve actuating means including a valve operating piston member slidable in said valve cylinder and engaging said auxiliary valve member.

4. A stock feed apparatus according to claim 1 wherein the auxiliary inlet port is arranged to apply fluid pressure to the auxiliary valve member when the latter is in its second position to normally bias the auxiliary valve member in a direction away from its second position, said pressure operated valve actuating means being arranged to move the valve member to its second position when the main control valve is operated to supply fluid pressure to the control chamber.

5. A stock feed apparatus according to claim 1 wherein said cylinder means includes a sleeve in said first portion of the bore having an outer diameter smaller than the cross-section of the first portion of the bore to define a fluid pressure chamber therebetween, said pressure supply passage means communicating with the bore externally of said sleeve, said cylinder means including means communicating said fluid pressure chamber with said cylinder means to apply fluid pressure to said rod end face on the piston.

6. A stock feed apparatus for intermittently advancing strip stock along a feed path comprising, a body having a bore therein generally paralleling the feed path, the bore having cylinder means in a first portion of the bore and fluid pressure operated valve means in a second portion of the bore, a feed piston mounted for axial reciprocation in the cylinder means and having a piston rod extending from one side of the piston and out of one end of the cylinder means, the piston having a rod end face at said one side and a main end face at the other side larger than said rod end face, a feed head on the piston rod external of said cylinder means, a feed clamp mounted on the feed head and a first fluid pressure operated means on the feed head for moving the feed clamp from a stock release to a stock engaging position, a stock holding clamp mounted on the body and a second fluid pressure operated means on the body for moving the stock holding clamp from a stock engaging position to a stock release position, the feed piston and piston rod having an axial passage extending through the piston and into the piston rod and communicating at the end remote from the piston with said first fluid pressure operated means, a tube slidably extending into the passage in the piston and piston rod and having one end communicating with that passage, means for anchoring the tube against axial movement relative to the body, the body having pressure supply passage means therein adapted for connection to a source of fluid pressure and exhaust passage means, a main control valve means including a main valve chamber in the body having a main valve inlet port communicating with said pressure supply passage means and a main exhaust port communicating with said exhaust passage means and a main control port, said main control valve means including a main control valve member in the main valve chamber movable from a first position communicating the main control port with the main inlet port and a second position communicating the main control port with the main exhaust port, means in said second portion of the bore defining a control chamber communicating with a second end of the tube, main control passage means in the body communicating said main control port with said control chamber and with said second fluid pressure operated means to supply fluid pressure thereto when the main control valve is in said first position, said pressure operated valve means including auxiliary valve casing means removably disposed in said second portion of the bore and defining an auxiliary valve chamber extending around the tube intermediate its ends and having an auxiliary inlet port and an auxiliary exhaust port and an auxiliary control port, said auxiliary valve casing means having a first passage means communicating the auxiliary inlet port with said pressure supply passage means in the body and a second passage means communicating the auxiliary exhaust port with said exhaust passage means in the body, said auxiliary valve casing means having auxiliary control passage means communicating said auxiliary control port with said cylinder means to apply and exhaust fluid pressure from the main end face of the piston, said pressure operated valve means including an auxiliary valve member guidably mounted on said tube for movement between a first position communicating said auxiliary control port with said auxiliary inlet port and a second position communicating said auxiliary control port with said auxiliary exhaust port, and an annular pressure operated valve actuating piston slidably mounted in said valve casing means coaxial with said auxiliary valve member, responsive to the pressure in said control chamber for moving said auxiliary valve member from said first to said second position when the main control valve supplies fluid pressure to the control chamber.

7. A stock feed apparatus according to claim 6 wherein the auxiliary valve chamber has first and second end faces disposed transverse to said tube and spaced apart axially thereof with said first end face at the end of the auxiliary valve chamber nearest to the cylinder means and the second end face at the end of the auxiliary valve chamber remote from the cylinder means, said auxiliary inlet port being formed in said first end face of the auxiliary valve chamber and said auxiliary exhaust port being formed in said second end face of the auxiliary valve chamber, said auxiliary valve member having first and second end faces extending transverse to said tube and spaced apart a distance less than the spacing of the first and second end faces of the auxiliary valve chamber to allow the auxiliary valve member to move axially in the auxiliary valve chamber between said first and second positions thereof, said pressure operated valve actuating means comprising an annular valve actuating piston having one side communicating with said auxiliary exhaust port and the other side communicating with the control chamber.

8. A stock feed apparatus according to claim 7 wherein said auxiliary inlet port and said auxiliary exhaust port are coaxial with said tube and each extend around the outer periphery of the tube.

9. A stock feed apparatus according to claim 6 wherein said cylinder means includes an annular cylinder head removably mounted in said bore adjacent said one end, said cylinder means also including a sleeve in said bore extending between said cylinder head and said valve casing means, said piston being slidably mounted in said sleeve and said piston rod extending through said cylinder head.

10. A stock feed apparatus according to claim 6 wherein said cylinder means includes an annular cylinder head removably mounted in said bore adjacent said one end, said cylinder means also including a sleeve in said bore extending between said cylinder head and said valve casing means and having an outer diameter smaller than said bore to define a pressure chamber in the bore around the sleeve, said piston being slidably mounted in said sleeve and said piston rod exending through said cylinder head, said pressure supply passage means communicating with said pressure chamber, and means communicating said pressure chamber with the inner side of said sleeve at the end adjacent said cylinder head to apply fluid pressure to the rod end face of the piston.

11. A stock feed apparatus for intermittently advancing strip stock along a feed path comprising, an elongated body having a bore extending therethrough generally paralleling the feed path and opening at first and second ends of the body, a first annular member removably mounted in the bore adjacent said first end of the body, a second annular member removably mounted in the bore intermediate the ends thereof, cylinder means in the bore between said first and second annular members, a feed piston slidable in said cylinder means and having a piston rod extending from one side and out through said first annular member and having an outer end external of the cylinder means, the piston having a rod end face at said one side and a main end face at the other side larger than said rod end face, said body having pressure supply passage means therein adapted for connection to a source of fluid pressure and exhaust passage means, means for supplying fluid pressure from said supply pressure means to said cylinder means at the end adjacent the first annular member to apply fluid pressure to the rod end face of the piston, a third annular member removably mounted in said bore and engaging the end of the second annular member remote from said cylinder means, a tube extending length-wise of said bore, said second and third annular members defining an auxiliary valve chamber extending around the tube intermediate the ends of the tube and having first and second end faces disposed transverse to the tube and spaced apart axially thereof, an auxiliary inlet port in said first end face of the auxiliary valve chamber communicating with said pressure supply passage means in the body and an auxiliary exhaust port in said second end face of the auxiliary valve chamber communicating with said exhaust passage means and an auxiliary control port communicating with said cylinder means, means in said bore adjacent the second end of the body for closing that end of the bore and defining a control chamber therein, a feed head mounted on the outer end of the piston rod for movement therewith, a feed clamp mounted on the feed head and first fluid pressure operated means on the feed head for moving the feed clamp from a stock release to a stock engaging position, a stock holding clamp mounted on the body and a second fluid pressure operated means for moving the stock holding clamp from a stock engaging position to a stock release position, the feed piston and piston rod having an axial passage therein and communicating at the end remote from the feed piston with the first fluid pressure operated means, the tube slidably extending into the passage in the piston and piston rod and having a first end communicating with that passage and a second end communicating with said control chamber, means for anchoring the tube against axial movement relative to the body, said third annular member having means defining an auxiliary valve cylinder at the side of said valve chamber remote from said cylinder means, an auxiliary valve member in said auxiliary valve cylinder guidably mounted on said tube for movement between a first position communicating said auxiliary control port with said auxiliary intake port and a second position communicating said control port with said auxiliary exhaust port, main control valve means including a main valve chamber in the body having a main valve inlet port communicating with said pressure supply passage means and a main exhaust port communicating with said exhaust passage means and a main control port communicating with said control chamber, said main control valve means including a main valve member movable from a first position communicating said main control port with said main inlet port and a second position communicating said main control port with said main exhaust port, and valve piston means in said valve cylinder means engageable with said auxiliary valve means, passage means communicating the valve cylinder means at one side of the valve piston means with said exhaust passage means, and passage means communicating the valve cylinder means at the opposite side of the valve piston means with said control chamber.

12. A stock feed apparatus according to claim 11 wherein said cylinder means includes a sleeve extending between said first and second annular members and having an outer diameter smaller than the bore to define a pressure chamber in the bore around the sleeve, said piston being slidably mounted in the sleeve and said piston rod extending through said first annular member, said pressure supply passage means communicating with said pressure chamber, and means communicating said pressure chamber with the inner side of the sleeve at the end adjacent said first annular member.

* * * * *